US006076601A

United States Patent [19]

Mooney, Jr.

[11] Patent Number: 6,076,601

[45] Date of Patent: Jun. 20, 2000

[54] COLLAPSIBLE CUTTER APPARATUS AND METHOD FOR CUTTING TUBULAR MEMBERS

[75] Inventor: James D. Mooney, Jr., Arlington, Tex.

[73] Assignee: Halliburton Energy Services, Inc., Duncan, Okla.

[21] Appl. No.: 09/096,424

[22] Filed: Jun. 11, 1998

[51] Int. Cl.[7] ..... E21B 29/00

[52] U.S. Cl. ..... 166/297; 166/55.1; 166/55.8

[58] Field of Search ..... 166/297, 376, 166/55, 55.1, 55.6, 56.7, 63

[56] References Cited

U.S. PATENT DOCUMENTS

| | | | |
|---|---|---|---|
| 4,116,130 | 9/1978 | Christopher et al. . | |
| 4,125,161 | 11/1978 | Chammas . | |
| 4,158,389 | 6/1979 | Chammas et al. . | |
| 4,180,131 | 12/1979 | Chammas . | |
| 4,208,966 | 6/1980 | Hart | 175/40 X |
| 4,250,960 | 2/1981 | Chammas . | |
| 4,298,063 | 11/1981 | Regalbuto et al. . | |
| 4,345,646 | 8/1982 | Terrell . | |
| 4,352,397 | 10/1982 | Christopher . | |
| 4,446,920 | 5/1984 | Woytek et al. . | |
| 4,494,601 | 1/1985 | Pratt et al. . | |
| 4,619,318 | 10/1986 | Terrell et al. . | |
| 4,776,394 | 10/1988 | Lynde et al. | 166/55.8 |
| 4,887,668 | 12/1989 | Lynde et al. | 166/55.8 |
| 5,287,920 | 2/1994 | Terrell . | |
| 5,509,480 | 4/1996 | Terrell et al. . | |
| 5,664,627 | 9/1997 | Boyd . | |

OTHER PUBLICATIONS

Pete DeFrank, Underwater Explosive Devices, Jul., 1967, pp. 1–6.

Inside Circular Cutters, Technical Sheet, Published by Jet Research Center, Inc., Arlington, Texas, Feb. 1, 1970, pp. 1–2.

Assembly and Running Instructions for Expandable Inside Circular Cutters Type SC50030, Manual, Published by Jet Research Center, Inc., Arlington, Texas, Dec., 1971, 9 unnumbered pages.

Steel Cutting Systems Brochure, Published by Jet Research Center, Inc., Copyright 1983, pp. 1–2.

Halliburton Explosive Services Brochure, Nov. 1996, pp. 3–5 and 3–6.

*Primary Examiner*—Roger Schoeppel

*Attorney, Agent, or Firm*—Robert A. Kent; Bill R. Naifeh

[57] ABSTRACT

In accordance with the present invention, a collapsible cutter assembly is provided that utilizes opposing collapsible assemblies having explosive charges coupled thereto. The collapsible cutter has an linear actuator assembly with a running position and a deployed position. Secured to the actuator is a first plurality of remotely-detonatable charges that are pivotally coupled to the actuator such that the first plurality of remotely-detonatable charges are splayed outward and toward a median of the actuator as the actuator moves from the running position to the deployed position. Also secured to the actuator is a second plurality of remotely-detonatable charges that are pivotally coupled to an opposing end, the second plurality of remotely-detonatable charges are splayed outward and toward the median of the actuator as the actuator moves from the running position to the deployed position. As the actuator continues to move to the deployed position, the first and the second plurality of remotely-detonatable charges are placed in a meshed-relation. In this manner, a substantially contiguous cutting profile is defined with the first and the second plurality of charges.

16 Claims, 14 Drawing Sheets

COLLAPSIBLE CUTTER APPARATUS AND METHOD FOR CUTTING TUBULAR MEMBERS

TECHNICAL FIELD

This invention relates to an apparatus and method for severing tubular members. More particularly, the invention relates to an improved collapsible cutter for severing a tubular member having an irregular inner diameter from the interior of the member.

BACKGROUND OF THE INVENTION

In the oil field industry, the need to sever tubular members at points inaccessible from the outside of the members often arises. Generally, such tubular members have irregular inner diameters caused by portions with smaller effective internal diameters than other portions thereof, such as constrictions caused by connectors that connect sections of the tubular members together.

For example, when oil and gas wells, and oil well platforms in ocean locations, become inactive or have reached their designed lifespan, they must be shut down. To form platform pilings in a body of water, tubular members are commonly utilized that extend from the floor of the water body to above the surface of the water body. The elongated tubular members have been assembled with pipe sections connected by special load-bearing connectors, which form internal constrictions.

Well platforms must be removed near or below a mud-line of the water body floor to eliminate navigational hazards. The explosives used to sever the legs of the platform must be internal to the tubular member to obtain the desired depth of cut. Generally, a rigid inner-diameter cutter was used to sever a tubular member. But such cutters have been ineffective to sever the legs due to internal constrictions such as stabbing guides and connectors.

There have been two primary removal or severing methodscbulk explosive and linear-shaped charge. Linear shaped charges are comprised of elongated masses of explosive material having V-shaped cross-sections, and are particularly well suited for such applications because of the great level of control afforded these explosives. Upon detonation of such linear-shaped charges, the V-shape of the explosive material generates a substantially unidirectional explosive jet or vector capable of deep penetration in steel targets/structures. However, an air space is required between the linear-shaped charge and the target to be severed to allow the explosive jet to travel a distance substantially unfettered before meeting incompressible liquids or other obstructions to achieve proper penetration of the target. The air space distance required to achieve proper penetration of the target is known in the art as the "stand-off" distance.

Also, linear-shaped charges were preferred because a minimal amount of explosive compounds were needed to sever a tubular member, allowing a well platform to be dismantled in a controlled manner. To sever a tubular member, the linear-shaped charge must be placed adjacent the region to cut. However, to do so, the explosive must first be run or "fished" through the internal constrictions to the target region, also known as the sever region, and be capable of being deployed at the sever region.

Attempts have been made to deploy a charges through internal constrictions and yet be deployed for detonation of linear-shaped charges. For example, U.S. Pat. No. 4,116,130, issued on Sep. 26, 1978, to Christopher et al., discloses a device for severing tubular members with internal constrictions. The device has a pair of identical hinged-together semicircular parts containing linear-shaped charges. To run through constrictions, the semicircular parts are in folded about a hinge and oriented in a vertical position such that the minimum constriction inner diameter is the radius of the semicircular parts. Upon reaching the portion of the tubular member to be severed, the semicircular parts are then rotated and unfolded towards a horizontal position.

Nevertheless, such severing devices have had inconsistent severing results, as well as the physical limitation on the narrowest internal constriction the device can pass through. Inconsistent severing has occurred from the inability to consistently deploy the cutter components into a planar shape, and irregular sever profiles result such as a V-shaped cut or skewed cut. With either of these irregular sever profiles, a substantial portion of the tubular member, known as a tab, remains, or the charge does not otherwise cut completely through the tubular member. In either case, the tubular member effectively remains intact. When the tubular member fails to be severed, then another trip, with the associated labor and materials expense, must be made to sever the tubular member.

Thus, a need exists for a collapsible cutter that can consistently be run through internal constrictions of a tubular member, and that can be consistently deployed to sever the tubular member.

SUMMARY OF THE INVENTION

In accordance with the present invention, a collapsible cutter assembly is provided which utilizes opposing collapsible assemblies with charges coupled thereto. The collapsible cutter has a first and a second plurality of remotely-detonatable charges pivotally. The first plurality of remotely-detonatable charges are coupled about a longitudinal axis such that the first plurality of remotely-detonatable charges are splayable outward, with respect to the longitudinal axis, from the running position of the collapsible cutter. The second plurality of remotely-detonatable charges are pivotally coupled about the longitudinal axis and are spaced apart from the first plurality of remotely-detonatable charges. The second plurality of remotely-detonatable charges are also splayable outward, with respect to the longitudinal axis, from the running position. At the deployed position of the collapsible cutter, the first and the second plurality of remotely-detonatable charges are longitudinally-urged together into a meshed-relation, thus defining a substantially contiguous cutting profile with the first and the second plurality of charges. The method of the present invention has the steps of placing the collapsible cutter within an interior of a tubular member adjacent a point to sever the tubular member. Once placed, then splaying the first and the second plurality of remotely-detonatable charges from the running position until the first and the second are in a meshed-relation at the deployed position. At the deployed position, a substantially contiguous cutting profile is defined with the first and the second plurality of charges. The charges are detonated to substantially sever the tubular member.

BRIEF DESCRIPTION OF THE DRAWINGS

The accompanying drawing is incorporated into and forms a part of the specification to illustrate examples of the present invention. This drawing together with the description serves to explain the principles of the inventions. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawings in which.

DETAILED DESCRIPTION

The principles of the present invention and their advantages are best understood by referring to the illustrated embodiment depicted in the FIGURES, in which like reference numbers describe like parts. In these figures and the accompanying description arrow "C" is used to indicate the upward or uphole direction. The reverse of arrows "C" refers to the downward or downhole direction. The upward and downward directions used herein are for reference purposes only, and it is appreciated that not all tubular members, within or without wells, extend vertically, and that the present invention has utility in off-vertical tubular member configurations.

Figure 1:
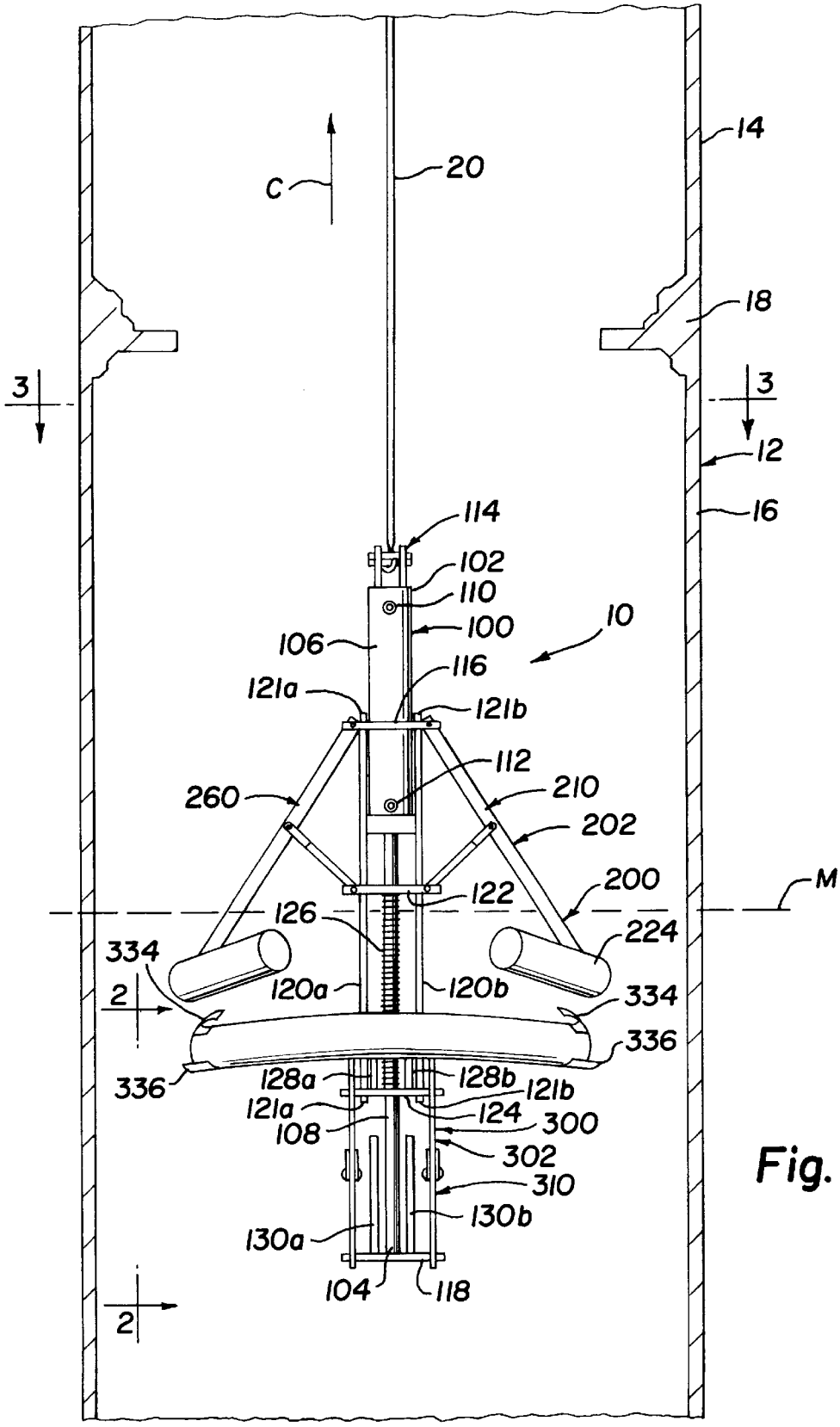
FIG. 1 is a front plan view of the present invention in a running position and disposed in a tubular member.

FIG. 1 is a front plan view of collapsible cutter of the present invention, which is generally designated by the numeral 10. The collapsible cutter 10 is illustrated in a running position—the position of the cutter while running in a hole or tubular member—for being lowered through an elongated tubular member 12. The tubular member 12 is typical of oil well casings or the elongated tubular members for forming pilings below the surface of a body of water. As illustrated, the tubular member 12 has at least two pipe sections 14 and 16 that are connected together by a connector 18.

The connector 18 can take a variety of forms, but often is used in offshore drilling operations and piling-forming operations includes inwardly extending structure for supporting one or more internal pipe strings. As a result, a constriction is formed within the member 12.

To sever the member 12, the collapsible cutter 10 is lowered by a cable 20 through the interior of the length of the member 12 and through the constrictions contained therein. While the tubular member 12 is shown positioned vertically in the drawings, and the collapsible cutter 10 is shown and described as being lowered within the interior of the tubular member 12, the collapsible cutter can also be lowered into members that are off-vertical. The collapsible cutter disclosed herein can be deployed in tubular members oriented at grades of up to about thirty-percent from vertical. The term sever as used herein means to disunite, disconnect, or divide into independent parts, or to cause to be disunited, disconnected, or divided into independent parts by substantially weakening the structure such that a tensile or torsional force can be applied to separate the structure into independent components.

As shown in FIG. 1, the collapsible cutter 10 has a piston assembly 100, shown in the running position. A first plurality of remotely-detonatable linear-shaped charges 200 are pivotally coupled to a first end 102 of the piston assembly 100. A second plurality of remotely-detonatable shaped-charges 300 are pivotally coupled to a second end 104 of the piston assembly 100. It should be noted that other forms of charges can be used with the present invention as needed to better accommodate different cutting or severing environments. Furthermore, the charges 200 and 300 can be continuous, either as linked tubes or semi-rigid tubular unit, so that when the collapsible cutter is in the running position, the charges 200 and 300 are in a helical arrangement until the collapsible cutter is placed in the deployed position, which is discussed later in detail.

The piston assembly 100 is a hydraulically-operated power cylinder 106 having a piston rod 108 extending from the cylinder 106. The cylinder 106 is of conventional design, including a movable piston disposed therein that is rigidly connected to the piston rod 108. Hydraulic hook-ups 110 and 112 are attached to the power cylinder 106 at the upper and lower ends, respectively, to manipulate the piston assembly 100. For clarity, hydraulic hose attachments to the hook-ups 110 and 112 are not shown, but it should be appreciated that they such hose attachments are routed with the collapsible cutter 10 using conventional techniques. A pin-and-shackle assembly 114 is connected to the cylinder 106. The pin-and-shackle assembly 114 is coupled to a cable 20 for lowering the collapsible cutter 10 within the interior of a tubular member to be severed.

Secured adjacent the first end 102 of the piston assembly 100 on the power cylinder 106 is a top plate 116. Secured adjacent the second end 104 of the piston assembly 100 on the piston rod 108 is a bottom plate 118.

Piston rod 108 extends through a top float plate 122 and a bottom float plate 124. Secured to the bottom float plate 124 are alignment rods 120*a*, 120*b*, 120*c*, and 120*d*, which maintain alignment of the plates of the collapsible cutter 10, and accordingly, the cutter arms 210, 260, 310, and 360. An opposing end of each of the alignment rods 120*a*, 120*b*, 120*c*, and 120*d*, is received through apertures defined in the top plate 116. Rod stops or nuts 121*a*, 121*b*, 121*c*, and 121*d* having enlarged diameters with respect to the alignment rods, are secured to each end of the alignment rods such that the rods can move vertically through the plates 116, 122, and 124. The alignment rods 120*a*, 120*b*, 120*c*, and 120*d* are of a length sufficient to extend from the bottom float plate 124 to the top plate 116 when the piston rod 108 is in the running position, as illustrated in FIG. 1.

Alignment rods 120*a*, 120*b*, 120*c*, and 120*d* also extend through the top float plate 122. That is, the top and the bottom float plates 122 and 124 are not fixed with respect to the piston assembly 100 so that they may travel longitudinally along the alignment rods 120*a*, 120*b*, 120*c*, and 120*d*, and the piston rod 108.

Between the top and the bottom float plates 122 and 124 and around the piston rod 108, is a compression spring 126. The compression spring 126 serves to transfer a linear force from the bottom float plate 124 to the top float plate 122. The linear force engaging the top float plate 122 deploys the first plurality of linear-shaped charges 200 as the piston rod 108 moves from the running position to the deploy position, which is discussed later in detail.

As shown, each of the plates 116, 118, 122, and 124 have a quadrilateral profile for ease of manufacture. Nevertheless, it can be appreciated that the plates can have other shapes to carry out the purpose of the present invention.

Extending from the bottom plate 118 toward the bottom float plate 124 are plate stops 130*a*, 130*b*, and 130*c*. Also, extending from the bottom float plate 124 toward the top float plate 122 are plate stops 128*a*, 128*b*, and 128*c*. The plate stops can be provided by a threaded shank that is secured to the respective plates by threading, welding, or other similar securing methods. Preferably, each of the threaded shanks is threadingly received by mating threads defined in the plates.

The plate stops dictate a minimum longitudinal distance between the respective plates. The minimum distance is a selected value that is sufficient to translate linear motion into a radial displacement of the first and the second plurality of linear-shaped charges 200 and 300 with respect to the piston assembly 100.

In FIG. 1, the first plurality of linear-shaped charges 200 are included with a top charge carriage assembly 202 to pivotally couple the charges 200 about the first end 102 of the piston assembly 100 such that the first plurality of charges 200 can be splayed or flared outward and toward a cutter assembly median M. Also, the second plurality of linear-shaped charges 300 are included with a bottom carriage assembly 302 to pivotally couple the charges 300 to the second end 104 of the piston assembly 100 such that the second plurality of charges 300 can also be splayed outward toward the median M. As shown, the top charge carriage assembly 202 and the bottom charge carriage assembly 302 are in an opposed relationship.

The cutter assembly median M is an intermediate point with respect to the piston assembly 100 that is situated between the first end 102 and the second end 104. The median M is the point in which the plurality of charges 200 and 300 mesh to form a contiguous charge adjacent the inner surface of the tubular member 12 sufficient to sever the member 12 upon detonation. The term Amesh@ as used herein means to come into or in working contact with to substantially achieve the purpose of severing a tubular member.

The top carriage assembly 202 includes a first and a second top cutter arm 210 and 260. As shown, each of the cutter arms 210 and 260 have substantially similar structures.

Figure 2:
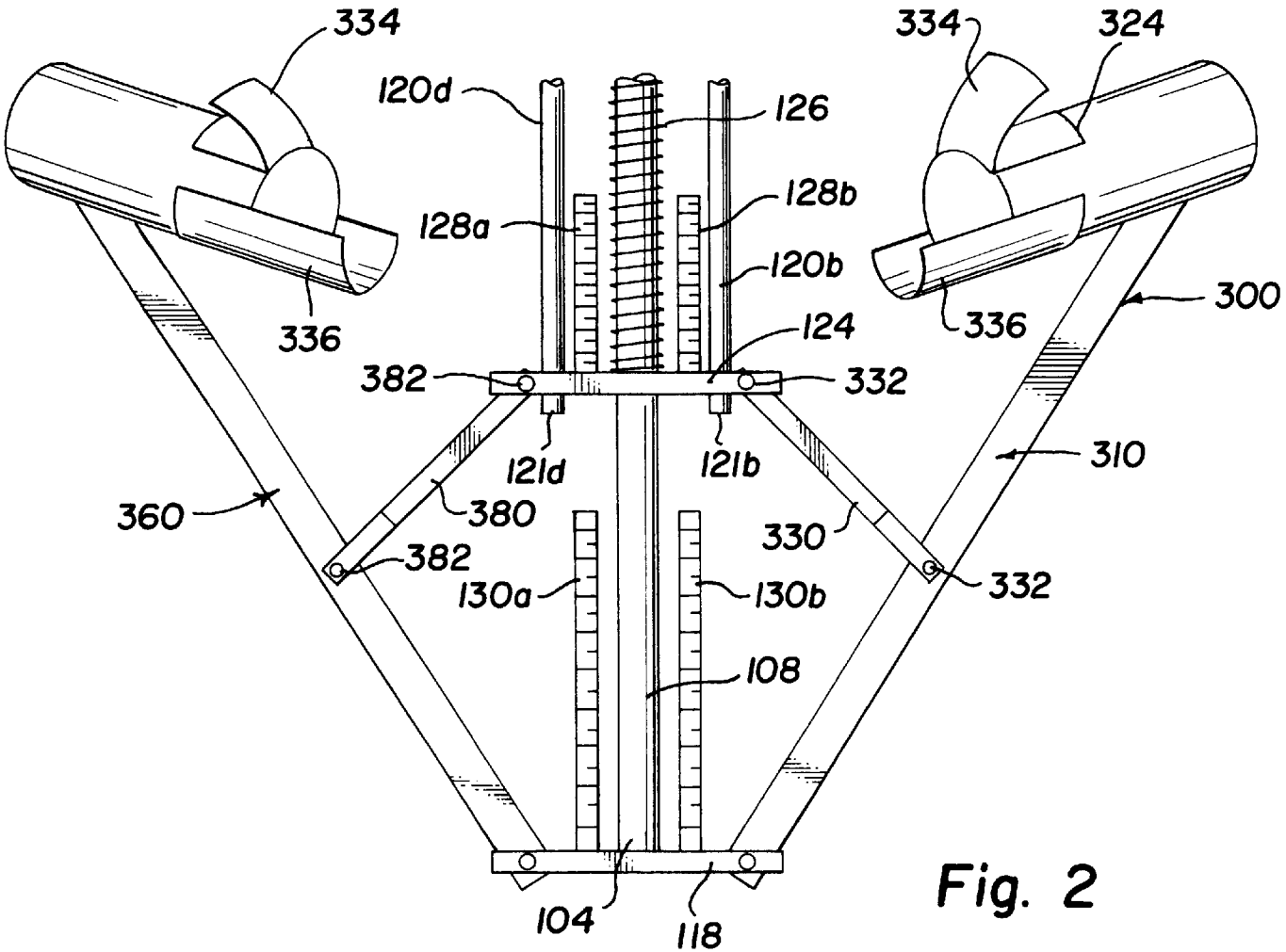
FIG. 2 is an enlarged partial side plan view of the present invention taken on line 2c2 of FIG. 1 looking in the direction of the arrows.

FIG. 2 shows the bottom carriage assembly 302 in further detail. The bottom carriage assembly 302 includes a first and a second top cutter arm 310 and 360. As shown, each of the cutter arms 310 and 360 have substantially similar structures.

Figure 3:
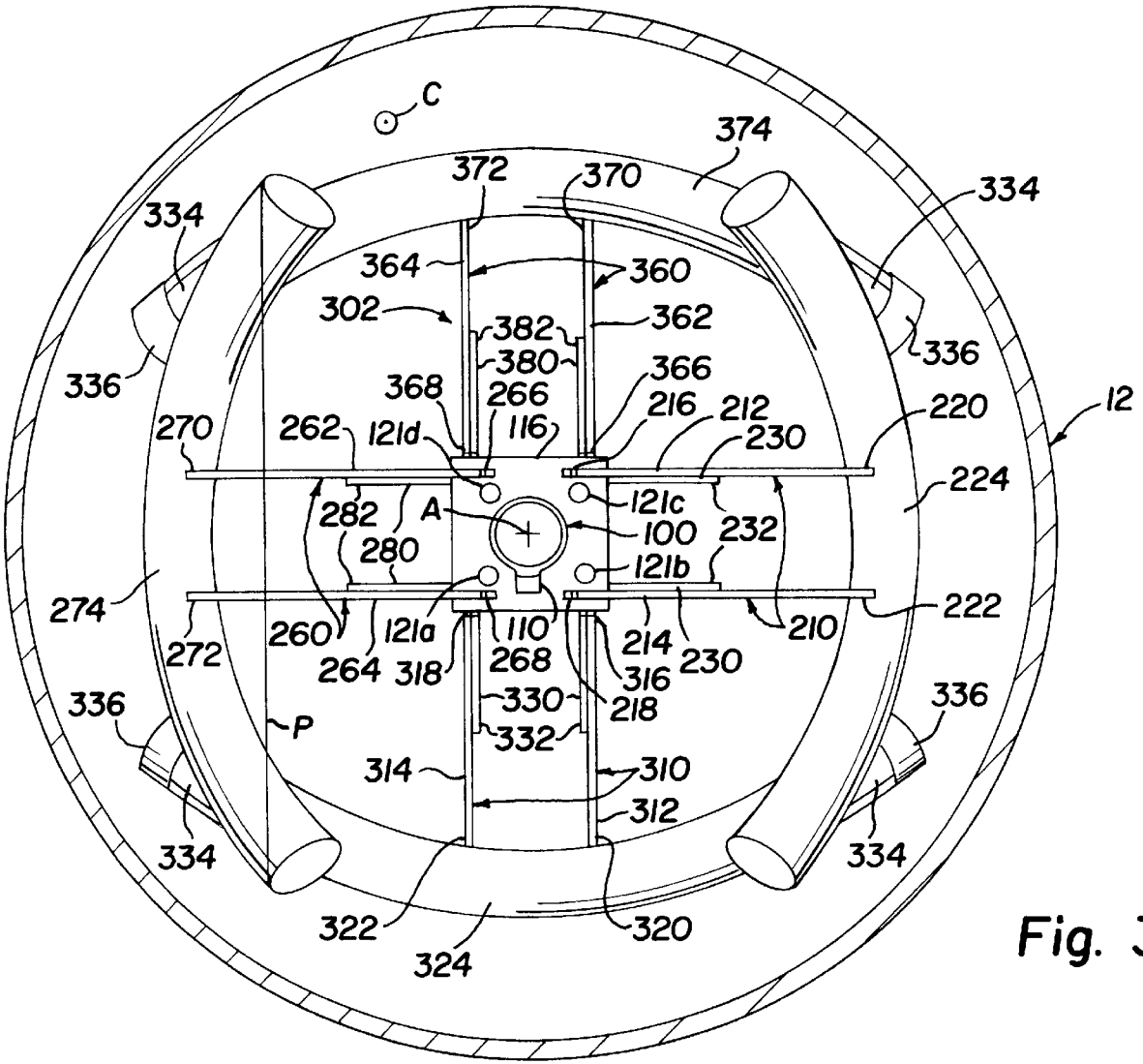
FIG. 3 is a top plan view of the present invention taken on line 3c3 of FIG. 1 looking in the direction of the arrows.

FIG. 3 is a top plan view that illustrates the interconnections of the top cutter arms 210 and 260 with respect to the piston assembly 100, as well as the interconnections of the bottom cutter arms 310 and 360 with respect to the piston assembly 100.

With respect to the top carriage assembly 202, the cutter arm 210 has a first member 212 and a second member 214. Each member 212 and 214 has a first end 216 and 218, respectively, pivotally coupled adjacent an outer edge of the top plate 116 of the piston assembly 100. The second end 220 of the first member 212, and the second end 222 of the second member 214, are secured in a fixed relation to the linear-shaped charge tube 224. Generally, the second ends 220 and 222 are spaced apart from each other the same distance as the first ends 216 and 218. Accordingly, the first member 212 and the second member 214 are in a substantially parallel relation. Further, the spaced-apart relation of the members limits the torsional movement of the charge tube 224 from torsional moments arising from deployment.

Cutter arm 260 has a first member 262 and a second member 264. Each member 262 and 264 has a first end 266 and 268 pivotally coupled adjacent an outer edge of the top plate 116 of the piston assembly 100. The second end 270 of the first member 262, and the second end 272 of the second member 264, are secured in a fixed relation to the linear-shaped charge tube 274. Generally, the second ends 270 and 272 are spaced apart from each other the same distance as the first ends 266 and 268. Accordingly, the first member 262 and the second member 264 are in a substantially parallel relation. The spaced-apart relation of the members limits the torsional movement of the charge tube 274 from torsional moments arising from deployment.

Support arms 230 are pivotally-attached with pivot joints 232 to the cutter arm members 212 and 214 and to the top float plate 122 (see FIG. 1). Support arms 280 are pivotally-attached with pivot joints 282 to the cutter arm members 262 and 264 and to the opposing side of top float plate 122 with respect to the connection of the support arms 230 (see FIG. 1). As best shown in FIG. 1, linear motion of the top float plate 122 along the alignment rods 120*a*, 120*b*, 120*c*, and 120*d*, is transferred to the first cutter arm 210 and the second cutter arm 260.

With respect to the bottom carriage assembly 302, cutter arm 310 has a first member 312 and a second member 314. Each member 312 and 314 has a first end 316 and 318, respectively, pivotally coupled adjacent an outer edge of the bottom plate 118 (see FIG. 2) of the piston assembly 100. The second end 320 of the first member 312, and second end 322 of the second member 314, are secured in a fixed relation to the linear-shaped charge tube 324. Generally, the second ends 320 and 322 are spaced apart from each other the same distance as the first ends 316 and 318. Accordingly, the first member 312 and the second member 314 are in a substantially parallel relation. The spaced-apart relation of the members limits the torsional movement of the charge tube 324 from torsional movements arising from deployment.

Cutter arm 360 has a first member 362 and a second member 364. Each member 362 and 364 has a first end 366 and 368, respectively, that are pivotally coupled adjacent an outer edge of the bottom plate 118 of the piston assembly 100 (see FIG. 2). The second end 370 of the first member 362, and second end 372 of the second member 364, are secured in a fixed relation to the linear-shaped charge tube 374.

Generally, the second ends 370 and 372 are spaced apart from each other the same distance as the first ends 366 and 368. Accordingly, the first member 362 and the second member 364 are in a substantially parallel relation. The spaced-apart relation of the members limits the torsional movement of the charge tube 374 from torsional moments arising from deployment.

Referring again to FIG. 3, support arms 330 are pivotally-attached with pivot joints 332 to the cutter arm members 312 and 314 and to the bottom float plate 126 (see FIG. 2). Support arms 380 are pivotally-attached with pivot joints 382 to the cutter arm members 362 and 364 and to the opposing side of bottom float plate 124 with respect to the connection of the support arms 330 (see FIG. 2). As best shown in FIG. 2, linear motion of the bottom float plate 124 along the alignment rods 120*a*, 120*b*, 120*c*, and 120*d*, is transferred to the pivotally-connected first cutter arm 310 and second cutter arm 360 through the support arms 330.

Referring again to FIGS. 1 and 2, the charge tubes 224, 274, 324 and 374 are secured to the respective cutter arms 210, 260, 310, and 360 at a slope with respect to the running position of the bottom carriage to a longitudinal axis of the collapsible cutter 10. The slope results from configuring the charge tubes to be substantially normal, or at a right angle to an inner circumferential surface of the tubular member 12 to be severed. Upon being placed in the running position, the charge tube slope results.

The running position of the collapsible cutter 10 is illustrated in FIGS. 1 through 3. The minimum effective outer diameter of the collapsible cutter 10 is determined by the largest chord distance P of the charge tubes 224, 274, 324, or 374. The chord distance P is a linear measurement between the outermost ends of a charge tube. Accordingly, the smallest effective outer diameter of the collapsible cutter 10, or running diameter, is with respect to the smallest chord distance P available of the charge tube segments. The smaller the charge tube segments, the smaller the running diameter. The minimum running diameter, with respect to the piston assembly 100 structure disclosed herein, is about ten (10) inches (about 25.4 centimeters).

As can be readily appreciated, the deployment of the collapsible cutter 100 has self-correcting capabilities with respect to longitudinal orientation in the tubing member to be severed, and the circumferential alignment to form a contiguous cut through the tubing member. In this nature, the structure of the collapsible cutter is generally aligned within a tubular member 12. The alignment within the tubing member is subsequently refined through forming a ring of charges along the inner diameter of the tubular member 12.

Figure 4:
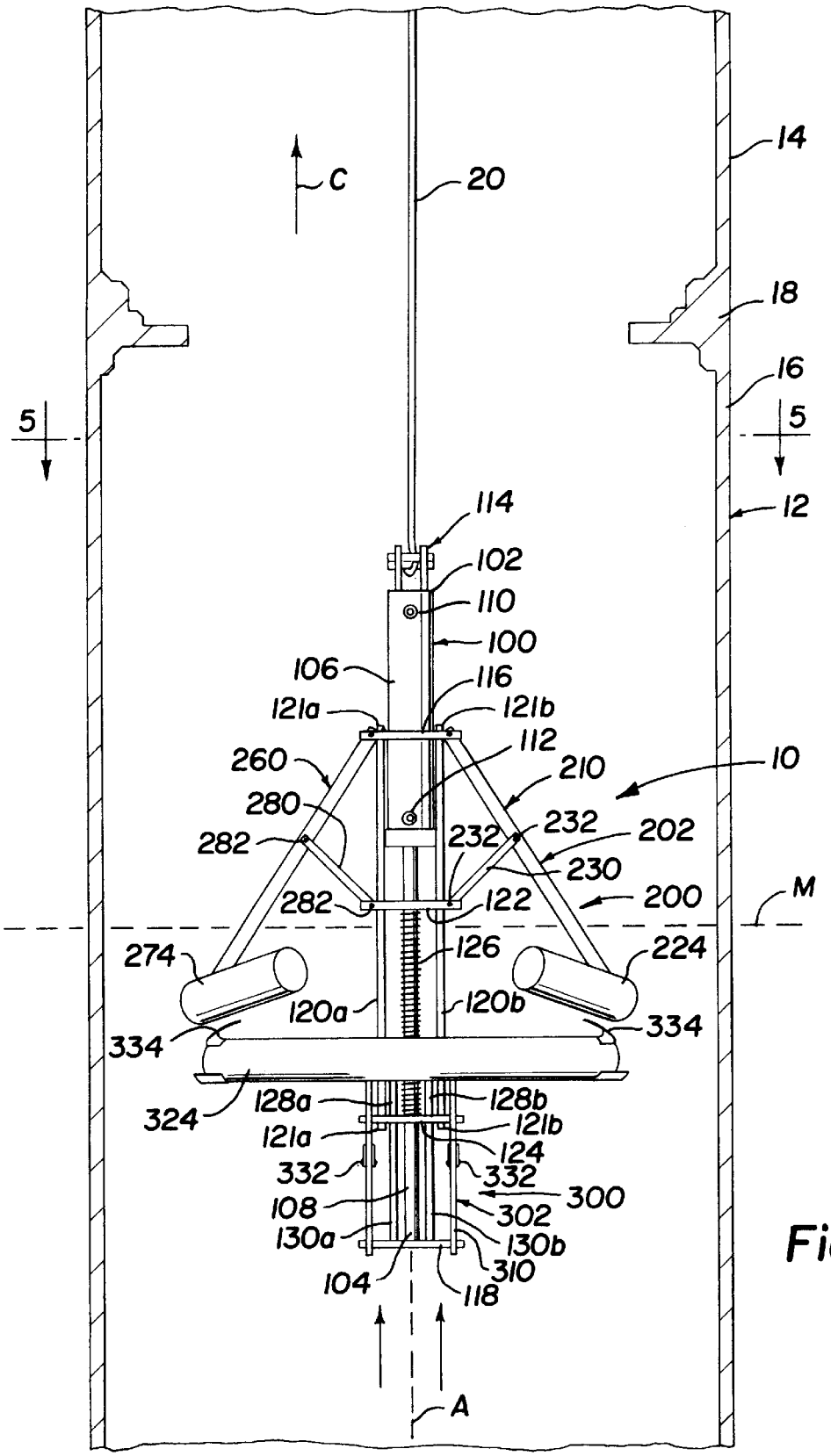
FIG. 4 is a front plan view of the present invention in which the bottom linear charges are splayed outward as the invention begins to move from a running position to a deployed position.

FIG. 4 shows the collapsible cutter 10 in the intermediate stage wherein the second plurality of charges 300, with charge tubes 324 and 374 are outwardly deployed by hydraulically-actuating the piston rod 108 of the piston assembly 100 through the hydraulic hook-ups 110 and 112. As the piston rod travels upward, the bottom plate 118 also travels upward.

As the bottom plate 118 travels upward, the longitudinal movement of the piston is diverted to the support arms 330 and 380 (best shown in FIG. 2) of the bottom carriage assembly 302. As the longitudinal movement is diverted, the first and the second cutter arms 310 and 360 are pivoted about their pivot points at the bottom plate 118 such that the charge tubes 324 and 374 splay outward with respect to a longitudinal axis of the piston assembly 100. As the bottom plate 118 travels upward, the plate stops 130*a*, 130*b*, and 130*c* engage the bottom float plate 124.

The compression spring 126 has a compression rating sufficient to substantially counteract forces conveyed to the bottom float plate 124 through the bottom carriage assembly 302 and through the support arms 330 and 380 (best shown in FIG. 2). That is, the compression spring 126 has a compression rating that provides a resistance greater than the longitudinal forces exerted against the bottom float plate 124 by the upward movement of the piston rod 108. In this manner, the forces are diverted to the path of least resistanceeradially outward through the support arms 330 and 380, and the first and the second cutter arms 310 and 360 of the bottom carriage assembly 302.

Figure 5:
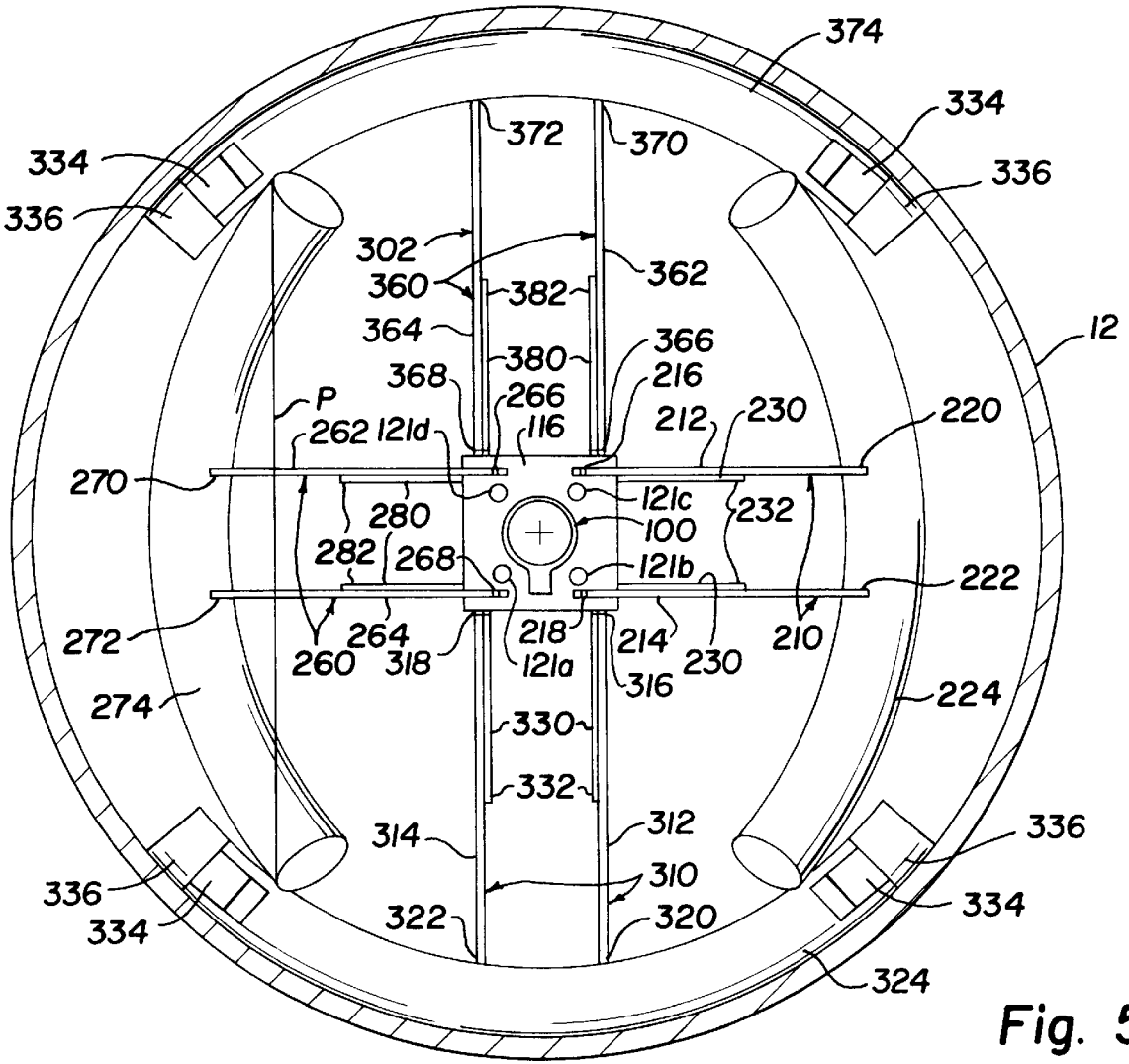
FIG. 5 is a top plan view of the present invention taken on line 5c5 of FIG. 4 looking in the direction of the arrows.

FIG. 5 better illustrates this radial displacement, or splaying, of the second plurality of charges 300. An advantage of the intermediate-stage deployment is the centering function of the collapsible cutter 10 with respect to the tubular member 12. With the intermediate-stage deployment, the charge tubes 324 and 374 are adjacent an inner surface of the tubular member 12. The collapsible cutter 10 is generally centered about a longitudinal axis of the tubular member 12 with respect to the deployed charge tubes 274 and 274.

Figure 6:
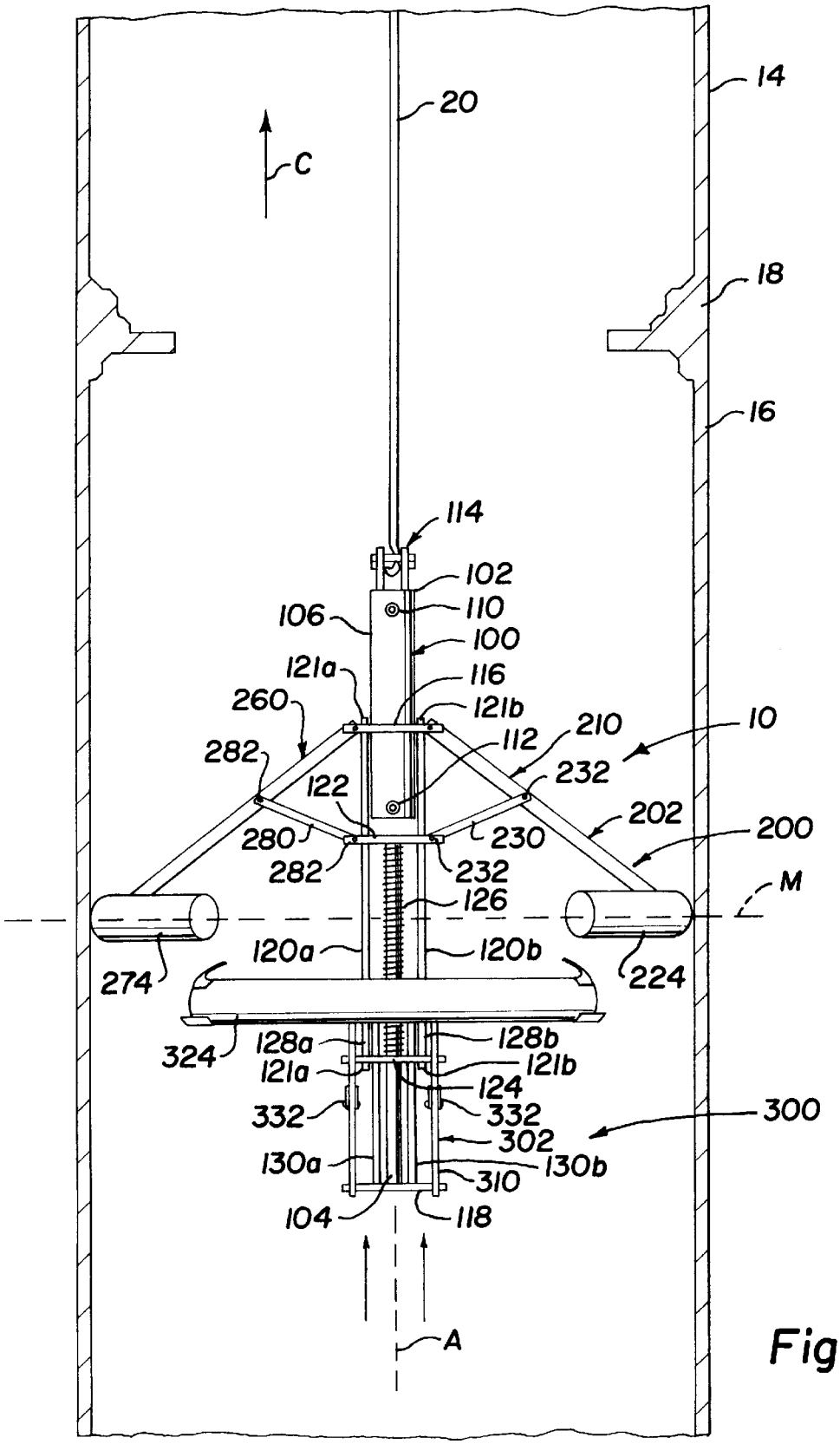
FIG. 6 is a front plan view of the present invention in which the top linear charges are splayed outward as the invention continues to move from a running position to a deployed position.

FIG. 6 illustrates the radial displacement or splaying of the first plurality of charges 200. With this next deployment stage of the collapsible cutter 10, the first plurality of charges 200, with charge tubes 224 and 274, are outwardly deployed by the continued upward travel of the hydraulically-actuated the piston rod 108 of the piston assembly 100 through continued pressurization through the hydraulic hook-up 112.

After engagement of the plate stops 130*a*, 130*b*, and 130*c* with the bottom float plate 124, the continued upward travel of the piston rod 108 transfers longitudinal movement to the compression spring 126. As the bottom float plate 124 continues traveling upward, the compression spring 126 begins to transfer force against the top float plate 122. With the force transfer to the top float plate 122, the compression spring 126 also becomes partially compressed. The longitudinal force of the piston rod 108 is conveyed through the support arms 230 to the first and the second cutter arms 210 and 260. The first and the second cutter arms 210 and 260 are pivoted about their pivot points at the top plate 116 such that the charge tubes 224 and 274 are splayed outward with respect to a longitudinal axis of the piston assembly 100. As shown, the upward travel of the top float plate 122 ceases when it is adjacent the bottom of the power cylinder 106. After the top charge carriage assembly 202 is deployed, the charge tubes 224 and 274 are adjacent an inner surface of the tubular member 12.

As shown in FIG. 6, the first plurality of charges 200 and the second plurality of charges 300 are longitudinally spaced-apart from each other. With both plurality of charges 224 and 274, and 324 and 374, placed adjacent the inner surface of the tubular member 12, a radial force with respect to the longitudinal axis A of the collapsible cutter assembly 100 results. The radial force further aligns the cutter assembly 100 with respect to the longitudinal axis of the tubular member 12. In this manner, further positioning refinement within the tubular member 12 is realized.

Figure 7:
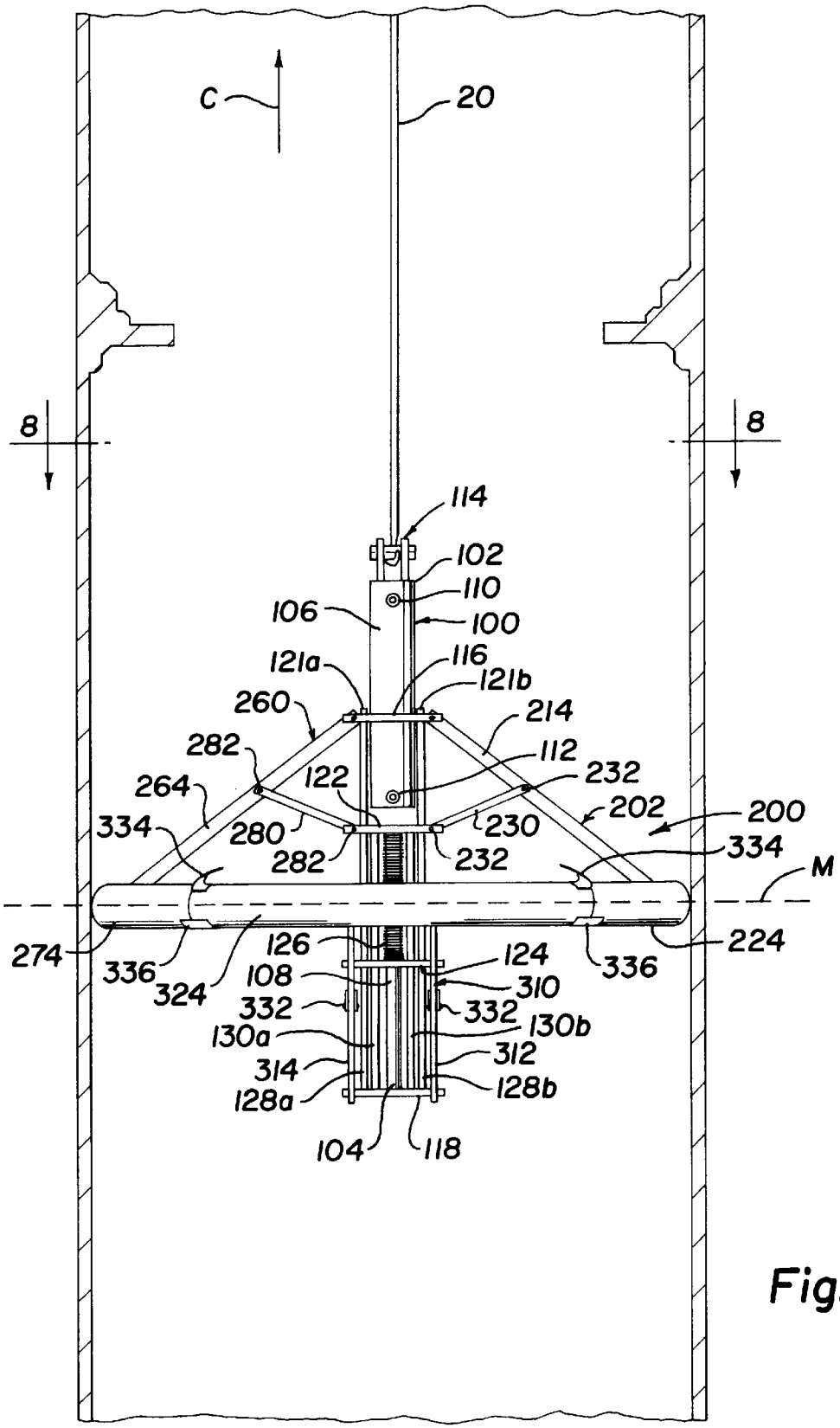
FIG. 7 is a front plan view of the present invention in the deployed position in which the top linear charges and the bottom linear charges are meshed to define a substantially contiguous cutting profile.

FIG. 7 illustrates the placement of the plurality of remotely-detonatable shaped-charges in a meshed-relation that defines a substantially contiguous cutting profile. As the piston rod 108 further moves upward as hydraulic pressure continues to be applied to the hydraulic hook-up 112, the compression spring 126 is further compressed, and the bottom charge carriage assembly 302 moves upward with the piston rod 108 toward the median M. As the carriage assembly 302 moves upward, the charge tubes 324 and 374 mesh with the charge tubes 224 and 274, defining the substantially contiguous cutting profile that forms a line along an inner diameter of the tubular member 12, best shown in FIG. 8.

Figure 8:
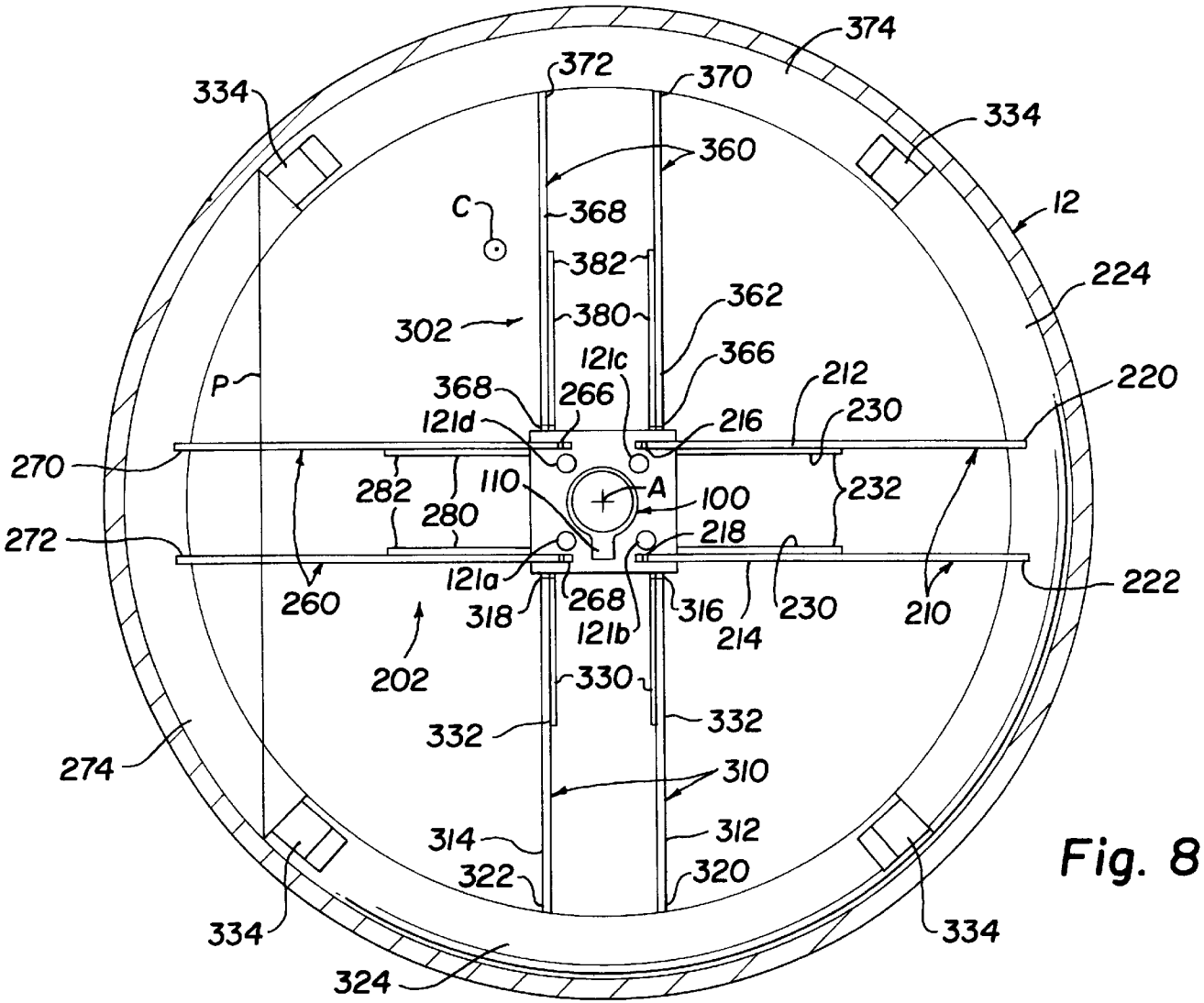
FIG. 8 is a top plan view of the present invention taken on line 8c8 of FIG. 7 looking in the direction of the arrows.

As also shown in FIGS. 7 and 8, the charge tubes 324 and 374 have tubing guides 334 and tubing stops 336 for further refining the alignment of the bottom charge tubes 324 and 374 with the top charge tubes 224 and 274.

With the charge tubes deployed to form a contiguous cutting profile, the linear-shaped charges contained within are detonated using well known techniques. Accordingly, for clarity, the detonation and associated wiring is not shown. For example, electrically-operated detonators are coupled to the explosives within the charge tubes 224, 274, 324, and 374. When the detonators are electronically activated, the resultant detonations are employed to initiate detonate the shaped charges. Electric wires travel from an end of the tubular member and travel with the collapsible assembly 10. The wires are coupled to a suitable power supply, which can be located adjacent the end of the tubular member to be severed.

Figure 9A:
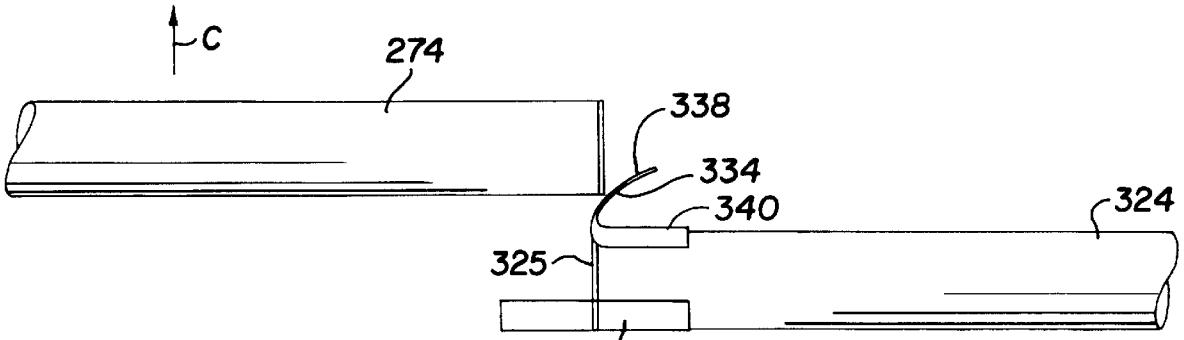
FIGS. 9A through 9C illustrate the alignment guides for the meshing of the charge tubes of the present invention.
Figure 9B:
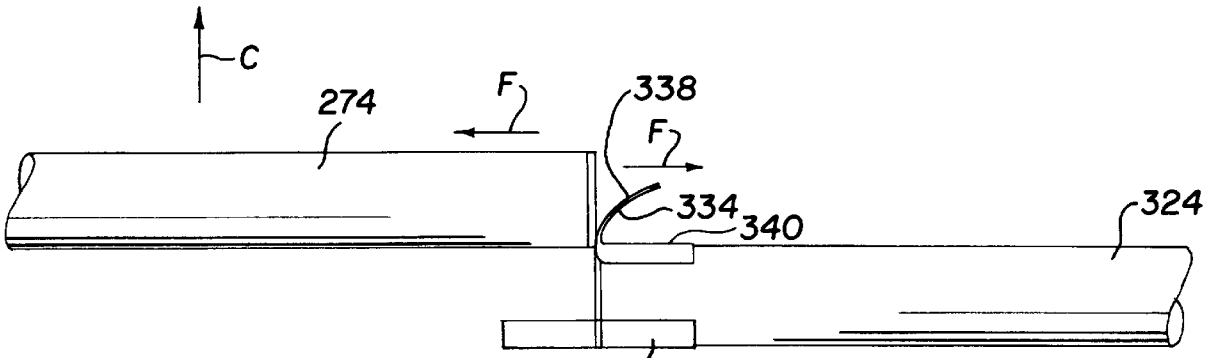
Figure 9C:
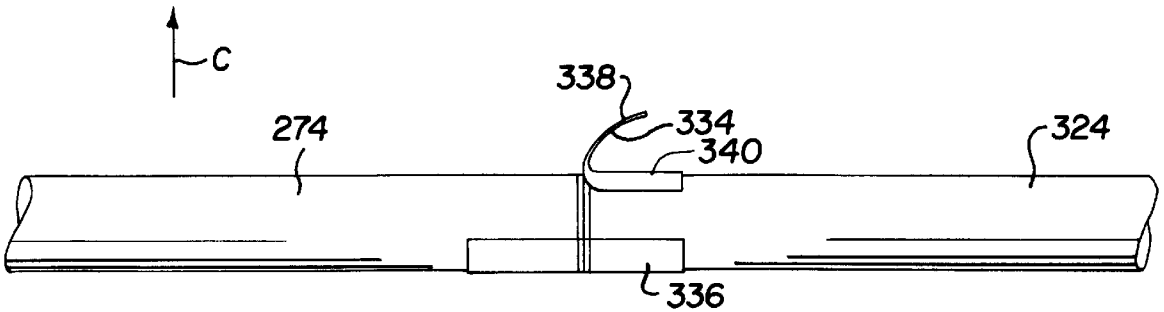

FIGS. 9A through 9C illustrate the operation of the tubing guides 334 and the tubing stops 336 as the bottom tube member 324 moves upward with respect to the top charge tube member 274. The tubing guide 334 has a concave ramp portion 338, which is parabolic in nature and has a general slope of about 60-degrees. The concave ramp portion 338 extends inwardly from a base 340, which is secured to the charge tube 324 by welding, bolting, or the like. The tubing stop 336 has a generally concave shape adaptable to the bottom surface of the charge tube 324. The apex of the tubing guide 334 generally aligns with the end 325 of the charge tube 324. The tubing guide 334 and the tubing stop 336 are preferably made of a strong, resilient material such as spring steel or the like. Preferably, the tubing guides are made of one-eighth inch (about 0.3 centimeters) thick steel flat bar, and the tubing stops are made of one-thirty-second ("1/32") inch (about 0.2 centimeters) thick spring steel.

FIG. 9A illustrates the initial engagement of the bottom charge tube 324 with the top charge tube 274. It should be noted that the charge tubes may already be substantially aligned; the tubing guides serve to refine the alignment of the tubes to achieve consistent severing with the respect to the target region. The bottom edge of the top charge tube 274 engages the ramp portion 338. Referring to FIG. 9B, the ramp portion 338 directs the top charge tube 274 to align with the end of the bottom charge tube 324, causing either of the charge tubes 274 or 324 to travel as indicated by the force vector lines F. Referring to FIG. 9C, upward travel of the bottom charge tube 324 is restricted with respect to the top charge tube 274 by the tubing stop 336.

Figure 10:
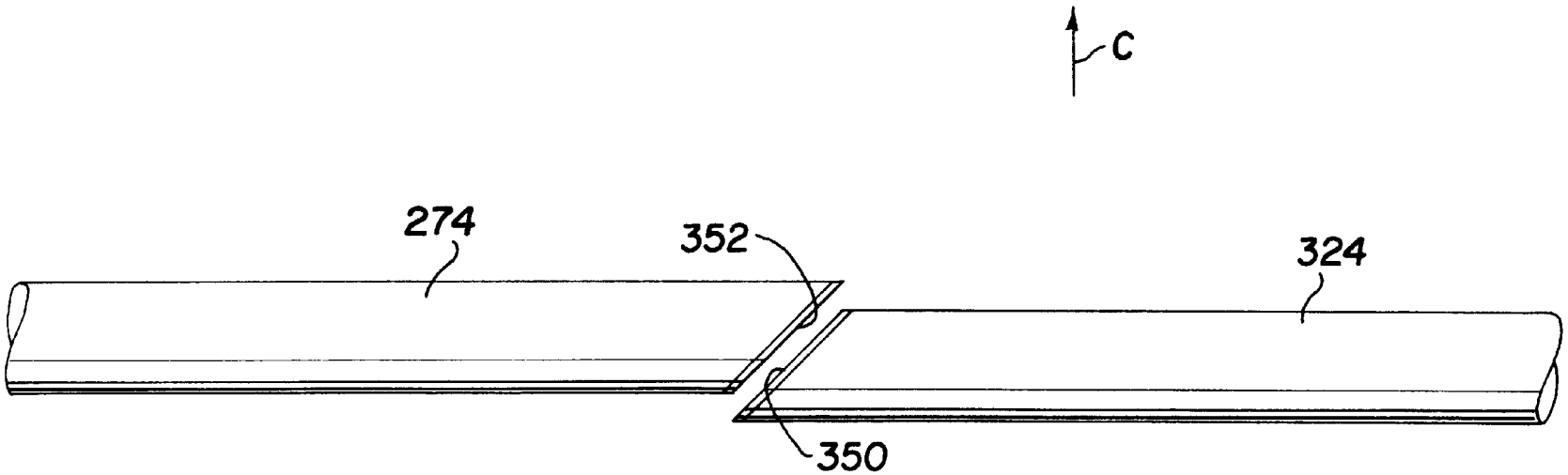
FIG. 10 illustrates an alternate alignment guide for meshing the charge tubes of the present invention.

In an alternate embodiment, the tubing guide 334 and the tubing stop 336 are integrally formed in the top charge tube 274 and the bottom charge tube 324, as shown in FIG. 10. The integral tubing guides and stop are provided by opposing ramped surfaces 350 and 352 each having a slope of about 60-degrees. It should be noted that other slopes can be used to achieve the desired alignment of the charge tubes, such as 45-degrees; but preferably the general slope of the ramp surfaces is about 60-degrees.

As discussed in detail above, the chord distance P of the charge tubes affect the minimum effective outer diameter of the collapsible cutter 10. Accordingly, for tubular members with inner constrictions-that can be up to or exceeding one-half of the inner diameter of the tubular member to be severed-the number of charge tubes deployed are increased to allow for a smaller effective outer diameter of the collapsible cutter in the running position.

For example, for a tubular member having an eighteen-inch inner-diameter, the collapsible cutter can have four charge tubes having an arcuate length of about 14 inches (about 36 centimeters), and a chord distance P of about 13 inches (about 32 centimeters). For four charge tubes to sever a tubular member having an inner diameter of about ninety-six inches, the arcuate length of each tube is about 75 inches (about 191 centimeters), and the chord distance P of each tube is about 68 inches (about 172 centimeters). For four charge tubes, the arcuate length is about [$\pi/4$*(target internal diameter)] and the chord distance P is about [0.71*(target internal diameter)]. Accordingly, to reduce the chord distance P, a greater number of charge tubes are used to allow for a smaller effective outer diameter of the collapsible cutter for running the cutter through narrower internal constrictions.

Accordingly, FIGS. 11 through 14 show a collapsible cutter 500 for tubular members having an enlarged, or larger, inner diameter.

Figure 11:
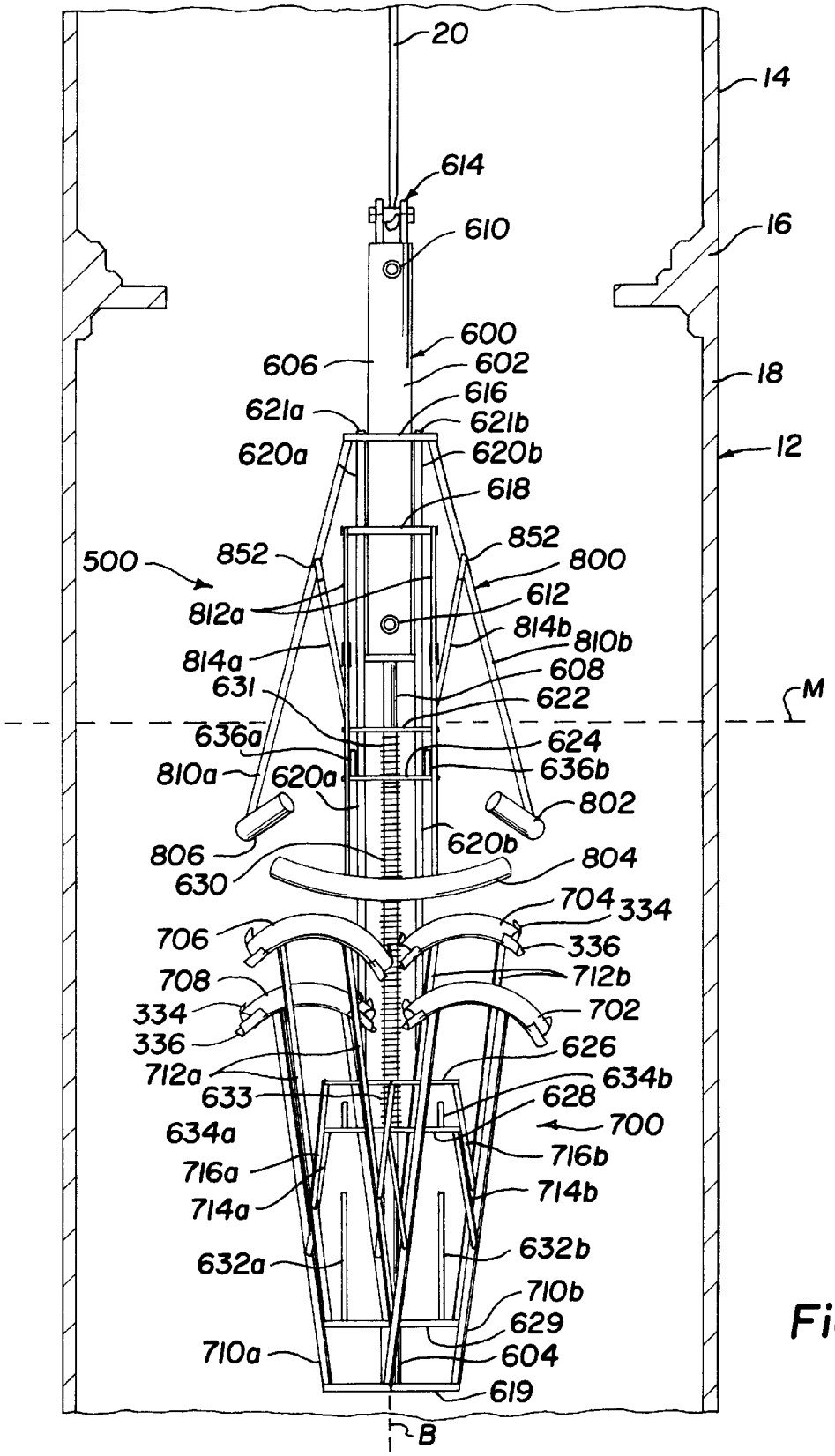
FIG. 11 is a front plan view of a further embodiment of the present invention, for tubular members having larger inner diameters, the further embodiment of the collapsible cutter shown in a running position.

In FIG. 11, the collapsible cutter 500 has a piston assembly 600. A bottom carriage assembly 700 having charge tubes 702, 704, 706, and 708, and a top carriage assembly 800 having charge tubes 802, 804, 806, and 808 that are pivotally mounted to the piston assembly 600. With eight charge tubes, the arcuate length of each tube becomes approximately equal to [$\pi/8$*(target internal diameter)] while the chord distance, P, is approximately [0.38*(target internal diameter)]. For the 96 inch target with eight charge tubes, the arcuate length of each charge tube is about 38 inches (96 centimeters) and the chord distance is about 37 inches (93 centimeters).

$$\text{arcuate length} = 0.3925 \times (\text{inner diameter of the target})$$

and has a chord distance P of about:

$$\text{chord distance } P \approx 0.1465 * (\text{inner diameter of the target})$$

here the target in this example is the tubular member 12. The piston assembly 600 is a hydraulically-operated power cylinder 606 having a piston rod 608 extending from the cylinder 606. The cylinder 606 is of conventional design, including a movable piston disposed therein, which is rigidly connected to the piston rod 608. Hydraulic hook-ups 610 and 612 are attached to the cylinder 606 at the upper and lower ends, respectively. For clarity, the hydraulic hose attachments to the hook-ups 610 and 612 are not shown, but it should be appreciated that they are routed with the collapsible cutter 500 using conventional techniques.

A pin-and-shackle assembly 614 is connected to the cylinder 606. The pin-and-shackle assembly 614 is coupled to a cable 20 for lowering the collapsible cutter 500 within the interior of a tubular member to be severed.

Secured adjacent the first end 602 of the piston assembly 600 on the cylinder 606 are first and second top plates 616 and 618. Secured adjacent the first end 602 of the piston assembly 600 is the first plate 616 that receives alignment rods 620*a,* 620*b*, 620*c*, and 620*d*, which maintain alignment of the plates of the collapsible cutter 500, and accordingly, the cutter arms 710*a*, 710*b*, 712*a*, 712*b*, 810*a*, 810*b*, 812*a*, and 812*b*. Secured adjacent the second end 604 of the piston assembly 600, on the piston rod 608, is a bottom plate 619. An opposing end of each of the alignment rods 620*a,* 620*b*, 620*c*, and 620*d*, and piston rod 608, extend through a first top float plate 622, a second top float plate 624, a first bottom float plate 626, and a second bottom float plate 628.

On each end of the alignment rods are rod stops or nuts, 621*a*, 621*b*, 621*c*, and 621*d*, respectively, that have enlarged diameters with respect to the alignment rods. The plates 622, 624, 626, and 628 are mounted such that the plates float between the top plates 616 and 618, which are fixed adjacent the first end 602 of the piston assembly 600, and the bottom plates 619 and 629, which are fixed adjacent the second end 604 and to the piston rod 608. That is, the float plates are not fixed with respect to the piston assembly 600 so that they may travel longitudinally along the alignment rods 620*a*, 620*b*, 620*c,* and 620*d* and piston rod 608. The alignment rods also limit rotational travel of the plates in the assembly with respect to each other. The alignment rods 620*a*, 620*b*, 620*c*, and 620*d,* are of a length sufficient to extend from the first top plate 616 to the second bottom float plate 628 when the piston rod 608 is in the running position, as illustrated in FIG. 11.

Extending between the first top float plate 624 and the second bottom float plate 628 and around the piston rod 608 is compression springs 630. Compression spring 629 extends between first and second bottom float plates 626 and 628. Compression spring 631 extends between first and second top float plates 622 and 624. The compression springs 633, 630, and 631 serve to transfer linear forces to the respective plates. Exertion of an upward linear force on the top float plates 622 and 624 deploys the first plurality of linear-shaped charges provided by the top carriage assembly 800 and charge tubes 802, 804, 806, and 808, as the piston rod 608 moves from the running position to the deploy position, which is discussed later in detail.

Each of the plates have a quadrilateral cross-section for ease of manufacture, and for orientation of the cutter arms with respect to each carriage assembly. Nevertheless, it can be appreciated that the plates can have other shapes to carry out the purpose of the present invention.

The cutter arms 710*a,* 710*b*, 712*a,* and 712*b,* of the bottom carriage assembly 700, and the cutter arms 810*a*, 810*b*, 812*a*, and 812*b*, of the top carriage assembly 800 are substantially similar in structure to the cutter arms 210, 260, 310, and 360, described in detail with respect to the collapsible cutter 10 shown in FIGS. 1 through 8.

The cutter arms 710*a* and 710*b* are pivotally secured to the piston assembly 600 adjacent the second end 604 at the first bottom plate 619. The cutter arms 712*a* and 712*b* are pivotally secured to the piston assembly 600 adjacent the second end 602 at the second bottom plate 629. This pivot arrangement allows the charge tubes 702, 704, 706, and 708 to be splayed radially-outward with respect to a longitudinal axis B of the cutter assembly 500.

The top carriage assembly cutter arms 810*a* and 810*b* are pivotally secured to the piston assembly 600 adjacent the first end 602 at the first top plate 616. Cutter arms 812*a* and 812*b* are pivotally secured to the piston assembly 600 adjacent the first end 602 of the piston assembly 600 at the second top plate 618. This pivot arrangement allows the charge tubes 802, 804, 806, and 808, to splay radially-outward with respect to the longitudinal axis B of the cutter assembly 500, and to mesh with the charge tubes 702, 704, 706, and 708 into a meshed-configuration to form a contiguous charge adjacent the inner surface of a tubular member 12 sufficient to sever the member 12 upon detonation.

Longitudinal force generated by the piston rod 608 is transferred to the sequence of float plates through the plate stops. Plate stops 632*a,* 632*b*, 632*c*, and 632*d* extend from the second bottom plate 629 toward the second bottom float plate 628. Plate stops 634*a*, 634*b,* and 634*c* extend from the second bottom float plate 628 toward the first bottom float plate 626. Similarly, plate stops 636*a*, 636*b*, and 636*c* extend from the second top float plate 624. Additional plate stops are similarly situated on the first bottom float plate 626 that extend toward the second top float plate 624.

The plate stops can be provided by a threaded shank that is secured to the respective plates by threading, welding, or other similar securing methods. Preferably, the plate stops are threadingly received in the plate through pre-threaded bores defined in the plate stops. The plate stops dictate a minimum linear distance between the respective plates. The minimum distance is a selected value that is sufficient to translate linear motion of the piston rod 608 into radial displacement of the first and the second plurality of linear-shaped charges provided by the bottom carriage assembly 700 and the top carriage assembly 800, which is discussed later in detail.

The cutter arms 710*a* and 710*b* are opposingly connected to the first bottom plate 619. The cutter arms 712*a* and 712*b* are opposingly connected to the second bottom plate 629. The second bottom plate 629 is generally aligned with respect to the first bottom plate 619, and the cutter arms 712*a* and 712*b* are aligned a quarter-turn, or ninety-degrees out-of5 phase, with respect to the cutter arms 710*a* and 710*b*. In this manner, the charge tubes 702, 704, 706, and 708 are spaced-apart in ninety-degree increments in a radial manner with respect to each other.

Referring to the top carriage assembly 800, the first and the second top plates 616 and 618, and the first and the second top float plates 622 and 624 are generally aligned with each other. The cutter arms 810*a* and 810*b* are opposingly connected to the first top plate 616. The cutter arms 812*a* and 812*b* are opposingly connected to the second top plate 618. The second top plate 618 is generally aligned with respect to the first top plate 616, and the cutter arms 812*a* and 812*b* are aligned a quarter-turn, or ninety-degrees out-of-phase, with respect to the cutter arms 810*a* and 810*b*. In this manner, the charge tubes 802, 804, 806, and 808 are radially spaced-apart in ninety-degree increments with respect to each other.

As illustrated in FIG. 11, the top plates 616, 618, 622, and 624 are aligned an eighth-turn, or forty-five degrees, with respect to the bottom plates 619, 629, 626, and 628. With this orientation of the plates, the meshing of the bottom carriage assembly charge tubes 702, 704, 706, and 708, can occur with the top carriage assembly charge tubes 802, 804, 806, and 808. That is, the general deployed radial-orientation of the bottom charge tubes 702, 704, 706, and 708 is at 0 E, 90 E, 180 E, and 270 E. The deployed radial-orientation of the top charge tubes 802, 804, 806, and 808 is 45 E, 135 E, 225 E, and 315 E. This orientation is further illustrated in FIGS. 12 through 14.

The deployment of the collapsible cutter assembly 500 is similar to that of the collapsible cutter assembly 10 illustrated in FIGS. 1–10. The primary advantage is the ability for the cutter assembly 500 to pass through narrower internal constrictions. A further advantage of the collapsible cutter assembly 500 is the ability to sever tubular members having a larger inner diameter than the effective outer diameter of the collapsible cutter assembly 10, while also having the ability to pass through internal constrictions created, for example, by connector 18. This advantage is further realized in part by increasing the number of charge tubes, which in turn decreases the chord distance P of the charge tubes. As stated earlier with respect to the cutter assembly 10, this dimension affects the size of the constriction a collapsible cutter assembly can pass through.

Figure 12:
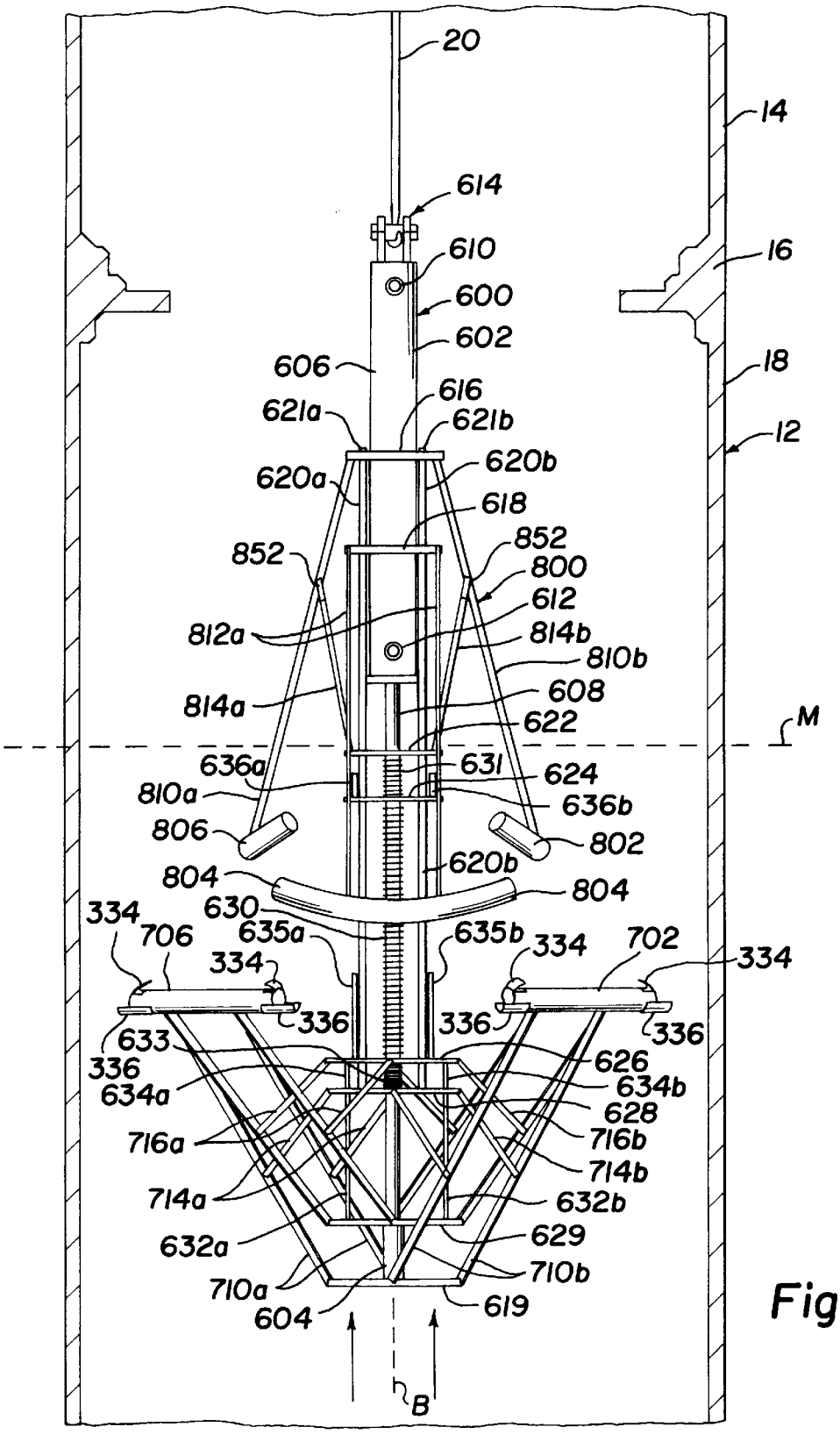
FIG. 12 is a front plan view of the further embodiment of the present invention in which the bottom linear charges are splayed outward as the invention begins to move from a running position to a deployed position.

In FIG. 12, the deployment of the cutter arms 710*a*, 710*b*, 712*a*, and 712*b*, is shown, which results in the radial displacement or splaying of the first plurality of charges through the charge tubes 702, 704, 706, and 708.

As the piston assembly 600 is actuated through the hydraulic hook-ups 610 and 612, the charge tubes are splayed outward by the continued upward travel of the hydraulically-actuated the piston rod 608 of the piston assembly 600.

The longitudinal travel of the piston rod 608 is translated by the bottom carriage assembly support arms 714*a*, 714*b*, 716*a*, and 716*b*, and by the top carriage assembly support arms 814*a*, 814*b*, 816*a*, and 816*b*. The support arms 714*a* and 714*b* are pivotally-attached with pivot joints 752 to the cutter arm members 710*a*, 710*b*, and to the second bottom float plate 628, and support arms 716*a*, and 716*b*, are pivotally-attached with pivot joints 752 to the cutter arm members 712*a* and 712*b*, and to the first bottom float plate 626. With respect to the bottom carriage assembly 700, cutter arms 710*a* and 710*b* each have a first member and a second member. Generally, the cutter arm members of cutter arm 710*a* and 710*b* are in a substantially parallel relation. The spaced-apart relation of the members limits the torsional movement of the charge tubes 702, 704, 706, and 708 from torsional movements arising from deployment.

The longitudinal travel of the piston rod 608 is translated by the top carriage assembly support arms 814*a*, 814*b*, 816*a*, and 816*b*, and by the top carriage assembly support arms 814*a*, 814*b*, 816*a*, and 816*b*. The support arms 814*a* and 814*b* are pivotally-attached with pivot joints 852 to the cutter arm members 810*a*, 810*b*, and to the first top float plate 622, and support arms 816*a*, and 816*b* are pivotally-attached with pivot joints 852 to the cutter arm members 812*a* and 812*b*, and to the second top float plate 624. With respect to the top carriage assembly 800, cutter arms 810*a* and 810*b* each have a first member and a second member. Generally, the cutter arm members of cutter arm 810*a* and 810*b* are in a substantially parallel relation. The spaced-apart relation of the members limits the torsional movement of the charge tubes 802, 804, 806, and 808 from torsional movements arising from deployment.

After the plate stops 632*a*, 632*b*, 632*c*, and 632*d* engage the second bottom float plate 628, the continued upward travel of the piston rod 608 transfers longitudinal force to the second bottom float plate 628. The second bottom float plate 628 has plate stops 634*a*, 634*b*, 634*c*, and 634*d* that engage the first bottom float plate 626. Accordingly, upward travel of the piston rod 608 is transferred to the first bottom float plate 626 through the compression resistance property of the springs.

As the first and the second bottom float plate 626 and 628 continue traveling upward, the compression spring 633 and 630 begin to transfer force against the first and the second top float plates 622 and 624. The longitudinal force of the piston rod 608 is conveyed through the support arms 814*a*, 814*b*, 816*a*, and 816*b*, and the compression spring 630 between the plates 626 and 624 is partially compressed as caused by the compression resistance of the spring between plates 624 and 622.

The cutter arms 810*a* and 810*b* are pivoted about their pivot points at the first top plate 616 such that the charge tubes 802 and 806 are splayed outward with respect to a longitudinal axis A of the piston assembly 600. As shown, the upward travel of the top float plates 622 and 624 ceases when they are adjacent the bottom of the power cylinder 606. After the top charge carriage assembly 800 is deployed, the charge tubes 802, 804, 806, and 808 are adjacent an inner surface of the tubular member 12.

Figure 13:
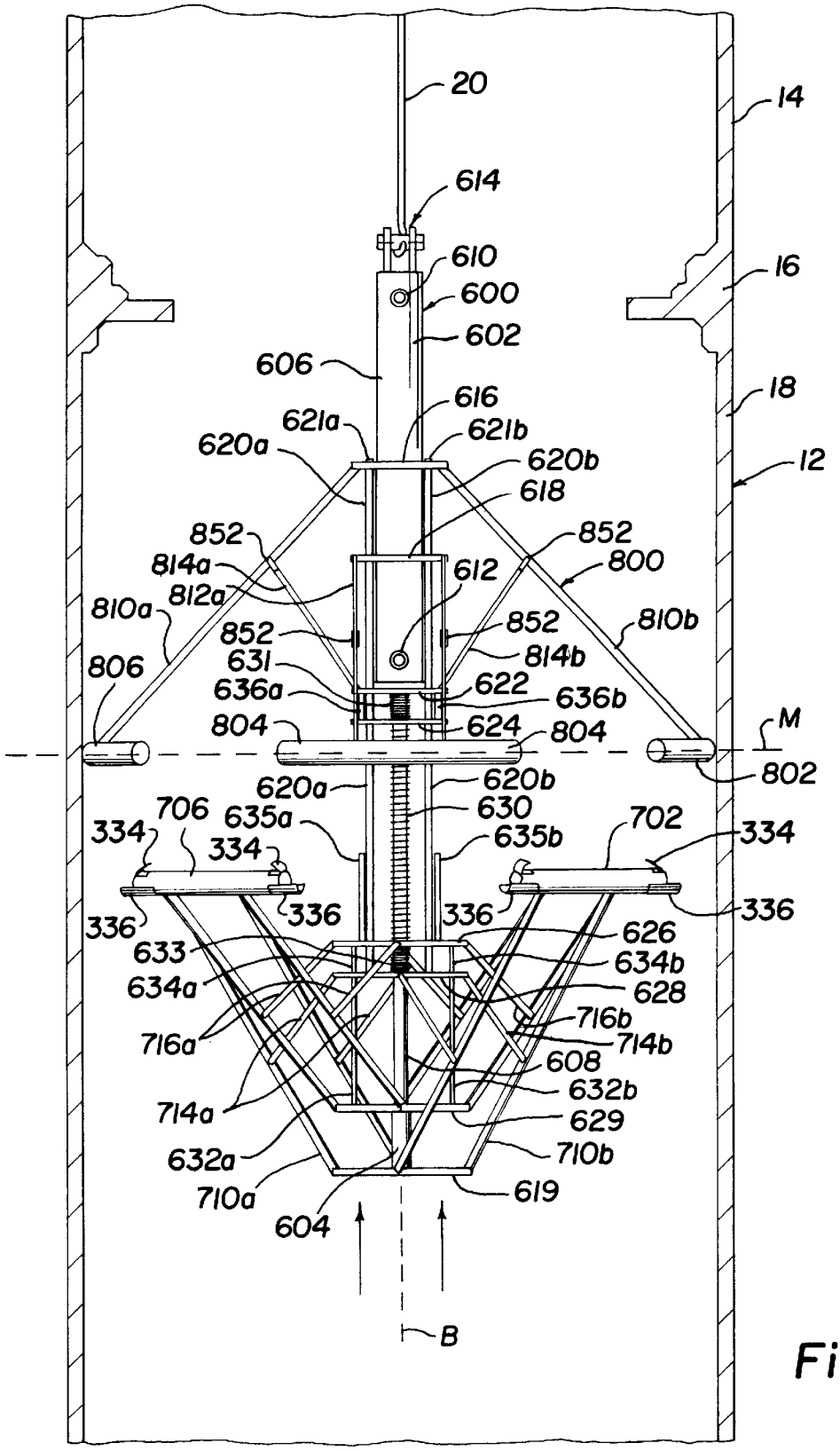
FIG. 13 is a front plan view of the further embodiment of the present invention in which the top linear charges are splayed outward as the invention continues to move from a running position to a deployed position.

As shown in FIG. 13, the first plurality of charges secured to the bottom carriage assembly 700, and the top carriage assembly 800, are longitudinally spaced-apart from each other. Compression springs 633 and 631 are substantially compressed, while compression spring 630 is partially compressed. As the first plurality of charge tubes 702, 704, 706, and 708, and the second plurality of charge tubes 802, 804, 806, and 808 are placed adjacent the inner surface of the tubular member 12, a radial force engages the longitudinal axis A of the collapsible cutter assembly 500 results. The radial force further aligns the cutter assembly 500 with respect to the longitudinal axis of the tubular member 12. In this manner, further positioning refinement within the tubular member 12 is gained.

Figure 14:
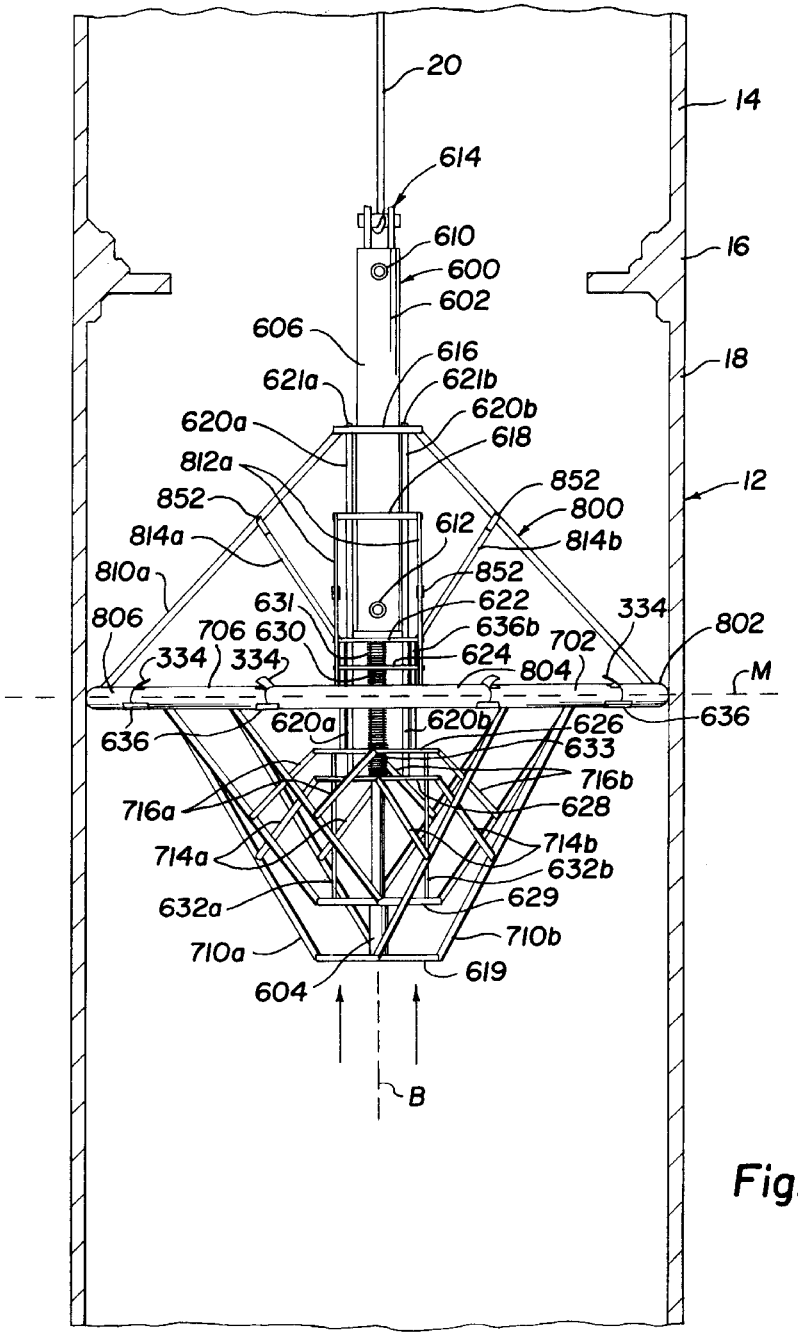
FIG. 14 is a front plan view of the further embodiment of the present invention in the deployed position in which the top linear charges and the bottom linear charges are meshed to define a substantially contiguous cutting profile.

FIG. 14 illustrates the placement of the plurality of remotely-detonatable shaped-charges in a meshed-relation that defines a substantially contiguous cutting profile. As the piston rod 608 further moves upward as hydraulic pressure continues to be applied to the hydraulic hook-up 612, the compression spring 630 becomes substantially compressed, and the bottom charge carriage assembly 700 moves upward with the piston rod 608 toward the median M. As the bottom carriage assembly 700 moves upward, the charge tubes 702, 704, 706, and 708 mesh with the charge tubes 802, 804, 806, and 808, defining a substantially contiguous cutting profile that forms a line along an inner diameter of the tubular member 12.

As also shown in FIG. 14, the bottom charge tubes 702, 704, 706, and 708 each have tubing guides 334 and tubing stops 336 for further refining the alignment of the bottom charge tubes 702, 704, 706, and 708 with the top charge tubes 802, 804, 806, and 808. The use of the tubing guides 334 and tubing stops 336 are discussed above with respect to FIGS. 9A through 9C.

Although the invention has been described with reference to a specific embodiment, these descriptions are not meant to be construed in a limiting sense. Various modifications of the disclosed embodiments, as well as alternative embodiments of the invention will become apparent to persons skilled in the art upon reference to the description of the invention. It is therefore contemplated that the claims will cover any such modifications or embodiments that fall within the true scope and spirit of the invention.

What is claimed is:

1. Apparatus for severing a tubular member comprising:

a first plurality of remotely-detonatable charges pivotally coupled about a longitudinal axis such that said first plurality of remotely-detonatable charges are splayable outward with respect to said longitudinal axis from a running position; and a second plurality of remotely-detonatable charges pivotally coupled about said longitudinal axis and spaced apart said first plurality of remotely-detonatable charges, said second plurality of remotely-detonatable charges are splayable outward with respect to said longitudinal axis from the running position, said first and said second plurality of remotely-detonatable charges longitudinally-urged together in a meshed-relation at a deployed position, wherein a substantially contiguous cutting profile is defined with said first and said second plurality of charges.

2. The apparatus for severing a tubular member of claim 1 further comprising:

a linear actuator extendable from the running position to the deployed position;

said first plurality of remotely-detonatable charges are pivotally coupled to said linear actuator through a first extendable carriage assembly pivotally coupled adjacent a first end of said linear actuator, said first carriage assembly having said first plurality of remotely-detonatable charges secured thereto; and said second plurality of remotely-detonatable charges are pivotally coupled to said linear actuator through a second extendable carriage assembly pivotally coupled adjacent a second end of said linear actuator, said second carriage assembly having said second plurality of remotely-detonatable charges secured thereto.

3. The apparatus for severing a tubular member of claim 2 wherein said linear actuator comprises a hydraulically-operated power cylinder having a piston rod extending therefrom.

4. The apparatus for severing a tubular member of claim 1 wherein said first and said second plurality of remotely-detonatable charges are linear-shaped charges contained in a charge tubing having an arcuate outer periphery.

5. The apparatus for severing a tubular member of claim 4 wherein said second plurality of remotely-detonatable charges further comprise:

a tubing guide adjacent each end of each of said second plurality of charges for urging said second plurality of charges with said first plurality of charges into said meshed-relation; and a tubing stop opposing said tubing guide and extending from a bottom periphery surface past each end of said second plurality of charges to maintain said meshed-relation with said first plurality of charges.

6. A collapsible cutter for deployment in a tubular member comprising:

a linear actuator extendable from [the] a running position to a deployed position;

a bottom carriage assembly pivotally coupled about a bottom end of said linear actuator to form an apex such that said bottom carriage can flare with respect to a longitudinal axis of said linear actuator;

a top carriage assembly pivotally coupled about a top bottom end of said linear actuator to form an apex such that said top carriage can flare with respect to said longitudinal axis of said linear actuator; and a plurality of remotely detonatable charges for serving said tubular member, said charges attached to a peripheral portion of said bottom carriage and said top carriage such that plurality of charges are in a meshed-relation when said linear actuator is in said deployed position, wherein a substantially contiguous cutting profile is defined with said plurality of charges.

7. The collapsible cutter of claim 6 wherein said linear actuator comprises a piston assembly.

8. The collapsible cutter of claim 7 wherein said piston assembly comprises a hydraulically-operated power cylinder having a piston rod extending therefrom.

9. The collapsible cutter of claim 6 wherein a first and a second plurality of remotely-detonatable charges are linear-shaped charges having an arcuate outer periphery.

10. The collapsible cutter of claim 9 wherein said second plurality of remotely-detonatable charges further comprise:

a tubing guide adjacent each end of each of said second plurality of charges for urging said second plurality of charges with said first plurality of charges into said meshed-relation; and a tubing stop opposite of said tubing guide and extending from a bottom periphery surface past each end of said second plurality of charges for maintaining said meshed-relation with said first plurality of charges.

11. Apparatus for severing a tubular member comprising:

a first plurality of remotely-detonatable charges pivotally coupled about a longitudinal axis; and a second plurality of remotely-detonatable charges pivotally coupled about said longitudinal axis and spaced apart from said first plurality of remotely-detonatable charges, said first and said second plurality of remotely-detonatable charges are splayable outward with respect to said longitudinal axis from a running position; said first and said second plurality of remotely-detonatable charges are interlinked such that when in said running position, said first and said second plurality of charges are in a helical configuration, and when in a deployed position said first and said second plurality of charges are urged together in a meshed-relation to define a substantially contiguous cutting profile.

12. The apparatus for severing a tubular member of claim 11 further comprising:

a linear actuator extendable from the running position to the deployed position;

said first plurality of remotely-detonatable charges are pivotally coupled to said linear actuator through a first extendable carriage assembly pivotally coupled adjacent a first end of said linear actuator, said first carriage assembly having said first plurality of remotely-detonatable charges secured thereto; and said second plurality of remotely-detonatable charges are pivotally coupled to said linear actuator through a second extendable carriage assembly pivotally coupled adjacent a second end of said linear actuator, said second carriage assembly having said second plurality of remotely-detonatable charges secured thereto.

13. The apparatus for severing a tubular member of claim 12 wherein said linear actuator comprises a hydraulically-operated power cylinder having a piston rod extending therefrom.

14. The apparatus for severing a tubular member of claim 11 wherein said first and said second plurality of remotely-detonatable charges are linear-shaped charges contained in a charge tubing having an arcuate outer periphery.

15. The apparatus for severing a tubular member of claim 14 wherein said second plurality of remotely-detonatable charges further comprise:

a tubing guide adjacent each end of each of said second plurality of charges for urging said second plurality of charges with said first plurality of charges into said meshed-relation; and a tubing stop opposing said tubing guide and extending from a bottom periphery surface past each end of said second plurality of charges to maintain said meshed-relation with said first plurality of charges.

16. A method of severing a tubular member comprising the steps of:

placing a collapsible tool within an interior of the tubular member adjacent a point to sever the tubular member, the collapsible tool including a first plurality of remotely-detonatable charges pivotally coupled about a longitudinal axis such that the first plurality of remotely-detonatable charges pivotally coupled about a longitudinal axis such that the first plurality of remotely-detonatable charges are splayable outward with respect to the longitudinal axis from a running position, a second plurality of remotely-detonatable charges pivotally coupled about the longitudinal axis and spaced apart from the first plurality of remotely-detonatable charges, the second plurality of remotely-detonatable charges are splayable outward with respect to the longitudinal axis from the running position;

splaying the first and second plurality of remotely-detonatable charges from the running position until the first and the second are in a meshed-relation when the collapsible tool is at a deployed position, wherein a substantially contiguous cutting profile is defined with the first and second plurality of charges; and detonating the first and second plurality of charges thereby substantially severing the tubular member.

* * * * *